US005934999A

United States Patent [19]

Valdez

[11] Patent Number: 5,934,999

[45] Date of Patent: Aug. 10, 1999

[54] ROULETTE-LIKE GAMING APPARATUS AND METHOD FOR PLAYING SAME

[76] Inventor: John M. Valdez, 1478 Clark Rd., Santa Fe, N.Mex. 87501

[21] Appl. No.: 08/839,360

[22] Filed: Apr. 17, 1997

Related U.S. Application Data

[60] Provisional application No. 60/015,792, Apr. 17, 1996.

[51] Int. Cl.[6] ..... A63F 5/02; A63F 9/24

[52] U.S. Cl. ..... 463/17; 273/142 E

[58] Field of Search ..... 463/17, 16, 20, 463/22; 273/142 E, 142 F, 142 B, 142 R, 138.2, 138.1, 274, 309, 123 R, 118 R

[56] References Cited

U.S. PATENT DOCUMENTS

| | | | |
|---|---|---|---|
| 3,693,977 | 9/1972 | de Keller | 273/274 X |
| 4,149,728 | 4/1979 | Thompson . | |
| 4,222,561 | 9/1980 | Whitten | 273/142 E |
| 4,321,673 | 3/1982 | Hawwass et al. | 463/22 |
| 4,357,015 | 11/1982 | Santora et al. . | |
| 4,396,193 | 8/1983 | Reinhardt et al. . | |
| 4,643,425 | 2/1987 | Herzenberg . | |
| 4,732,385 | 3/1988 | Castellanos . | |
| 4,735,416 | 4/1988 | McNally . | |
| 5,042,810 | 8/1991 | Williams . | |
| 5,116,055 | 5/1992 | Tracy . | |
| 5,249,800 | 10/1993 | Hilgendorf et al. . | |
| 5,259,616 | 11/1993 | Bergmann | 463/17 |
| 5,417,430 | 5/1995 | Breeding . | |
| 5,540,442 | 7/1996 | Orselli et al. | 463/17 |
| 5,544,893 | 8/1996 | Jones et al. . | |
| 5,584,763 | 12/1996 | Kelly et al. | 463/16 |
| 5,588,650 | 12/1996 | Eman et al. | 273/142 E |
| 5,639,089 | 6/1997 | Matsumoto et al. | 273/142 E |

FOREIGN PATENT DOCUMENTS 42 16 422 A1 5/1992 Germany .

*Primary Examiner*—Michael O'Neill
*Attorney, Agent, or Firm*—Kevin Lynn Wildenstein, Esq.

[57] ABSTRACT

The present invention is a progressive gaming device conceptually similar to a conventional roulette game. The present invention comprises a modified roulette wheel on a gaming table, a lighted display panel adjacent to the roulette wheel and built into the gaming table, a display unit at the head of the gaming table, a microcomputer and a key pad. When played, the present invention allows up to seven players to play. Play is effectuated under special rules, where a modified roulette wheel is spun by the croupier and three ivory balls are spun in a direction opposite the wheel's direction. When all balls fall into slots on the wheel, this information is sent to a nearby microcomputer for display on several display units, thereby allowing a croupier to determine payout and/or the progressive jackpot. The jackpot is progressive in that a percentage of every wager bet is placed back into the jackpot for availability during the next game.

20 Claims, 9 Drawing Sheets

SIDE VIEW

REAR VIEW

ROULETTE-LIKE GAMING APPARATUS AND METHOD FOR PLAYING SAME

This application claims the benefit of U.S. Provisional Application No.: 60/015,792 Filing date Apr. 17, 1996.

FIELD OF THE INVENTION

This invention relates to a gaming apparatus and method of playing the same, and more particularly, to a progressive gaming device which is similar to the rules and play of conventional roulette games.

BACKGROUND OF THE INVENTION

"Roulette" is a popular game of chance. A typical game of roulette is played with a wooden, precision wheel having numbers 1 through 36 and "0" and "00" embossed on the rim of the wheel. This wheel is known as the "roulette wheel" and is rotatably held within a structure called a bowl The wheel has numerous individual slots corresponding to each number used, and each number is embossed on the top surface of the wheel near the wheel's periphery. The roulette wheel is normally located at one end of a gaming table, and at the other end of the table, is a betting area which is variously marked with the same numbers as the numbers embossed on the roulette wheel. The betting area also includes other marked sections which can be used for side bets or other bets.

The operation of conventional roulette first requires players to place wagers (or, bets) in the betting area. The roulette wheel is then spun in one direction by the roulette operator (known as the "croupier"). The croupier then introduces a single, small ivory ball into the roulette wheel, sending it spinning around a stationary rimmed path above the roulette wheel in a direction opposite the direction of wheel's rotation. The rimmed path is integrally formed with the gaming table and the wheel. During the time the wheel is spinning and the ball is rolling in the stationary track, players are positioned a distance around the table and in most cases, cannot easily see the wheel spinning or the ball traveling. Subsequently, the ball travels the rimmed path until the momentum of the ball is sufficiently slowed (due to frictional and gravity forces) so that it falls from the wheel's rim, strikes one or more slots, and eventually falls into one of the numbered slots. Prior to the time the ball falls into a slot, bets are continuously made in the betting area. When the wheel has slowed sufficiently for the croupier to see which number is the winner, he places a marker on the winning number (i.e., corresponding to the numbered slot in which the ball fell) in the betting area, collects the losing bets and distributes the payout (or winnings) to the players who chose the slot containing the number which the ball fell into. The game can then be re-played.

Prior to the present invention, the gaming art has failed to provide a gaming device which combines the action of a modified roulette table with the excitement of a progressive jackpot. Progressive gaming devices are those devices which are linked together to form a progressive system. In progressive gaming, a percentage of each game played is used to determine the progressive jackpot value. As a result, the progressive jackpot value continually increases until a win (or "hit") occurs at one of the linked machines on the system. When this happens, the progressive jackpot is paid out to the person who operated the machine with the winning numbers and the progressive amount is reset (either manually or by electronic means), usually to some base jackpot value which casinos hold in reserve for such occasions. This process then repeats itself to thereby again increase the value of the progressive jackpot.

Prior art progressive gaming devices are usually limited to slot machines and/or card games, which are electrically connected to communicate information between computers or similar controller devices, such as money received by the machines or the amount of wins achieved on the machines. Typically, the incrementing value of the progressive payout is displayed on a large central display, or can be displayed on a number of remotely located displays. While these prior art progressive devices are financially successful to most casinos, manufactures of these systems continuously seek new variations of progressive gaming opportunities to stimulate game play, while at the same time stimulating enhanced profits for casinos. Unfortunately, progressive payouts are infrequent due to the high odds of winning. However, because most players dream of winning a large jackpot, progressive gaming devices can provide a handsome income for casino operators.

In light of the foregoing, it is an object of the present invention to add a progressive jackpot to a gaming apparatus having a modified roulette wheel.

It is an object of the present invention to provide a new gaming apparatus having a revised roulette wheel which is easy to learn and stimulates player interest.

It is an object of the present invention to provide a gaming apparatus which quickly determines which slot receives a roulette ball, calculates the winning combinations and provides indicia of the winning number combinations by illuminating selected areas on the betting surface of the present invention's gaming table and attached betting display It is also an object of the present invention to increase the fun and excitement of playing a revised version of roulette by having a means in which players can quickly determine whether they were successful at winning.

It is a further object of the present invention to provide a lighted, computerized progressive game based on a revised roulette wheel for crowd excitement and attraction, which is simple to service, and which provides a high drop for the house and a high win ratio for the players.

SUMMARY OF THE INVENTION

The present invention is a progressive gaming device conceptually similar to a conventional roulette game. The present invention comprises a modified roulette wheel on a gaming table, a lighted display panel adjacent to the roulette wheel and built into the gaming table, a display unit at the head of the gaming table a microcomputer and an optional optical number reader or an optional key pad. When played, the present invention allows up to seven players to play. In play, a modified roulette wheel is spun by the croupier and up to three ivory balls are spun in a direction opposite the wheel's direction. When all balls fall into slots on the wheel, this information is gathered by the optional optical number reader or a modified key pad, and is then sent to a nearby microcomputer for display on several display units, thereby allowing a croupier to determine payout. Finally, at the end of a game, the crouper manually resets the lights and the jackpot by use of the key pad. The present invention, with its modified roulette wheel and unique rules, stimulates player interest while increasing casino profits.

DESCRIPTION OF THE PREFERRED EMBODIMENT

Figure 1:
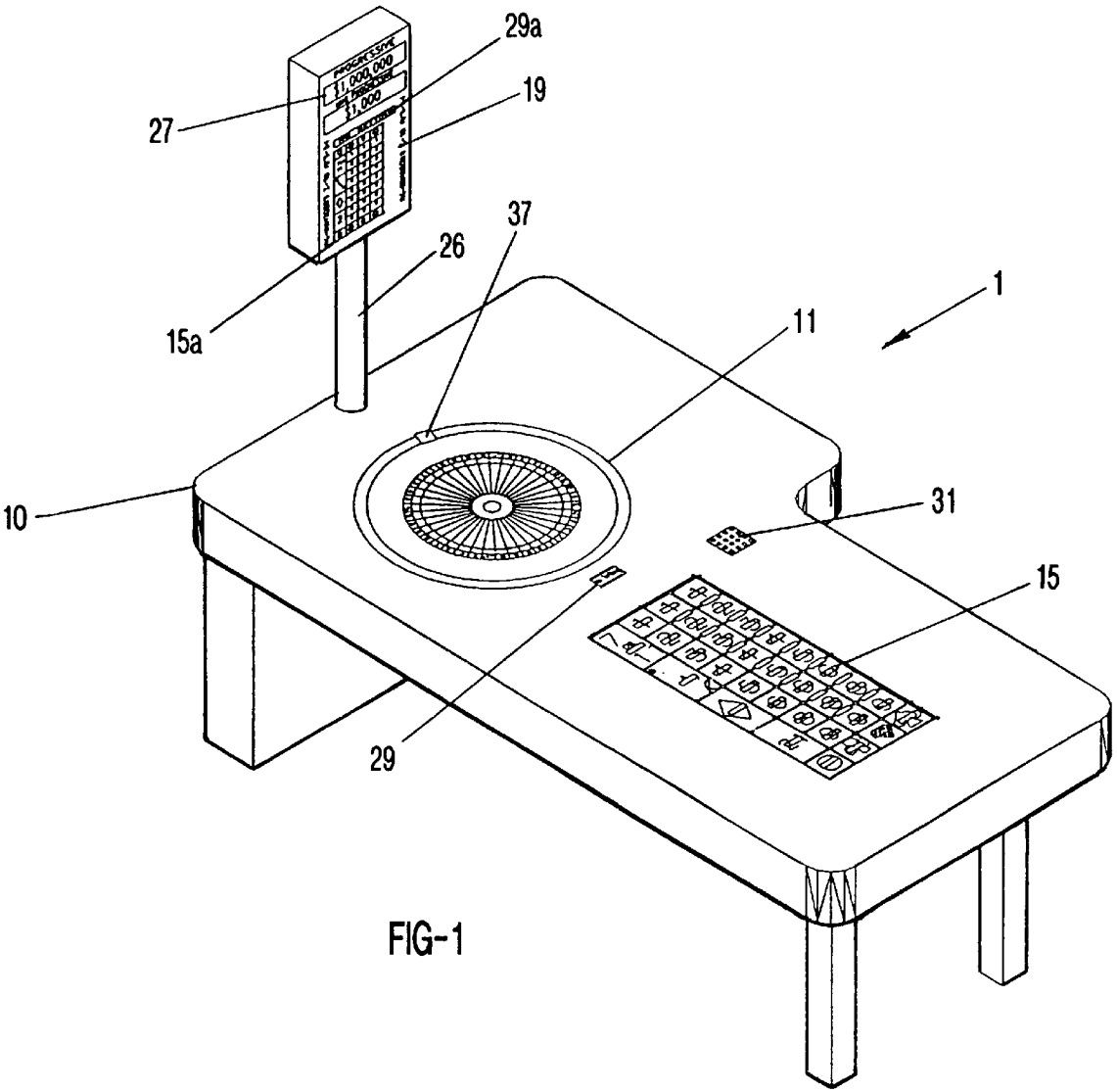
FIG. 1 is a left side perspective view of the present invention.
Figure 3:
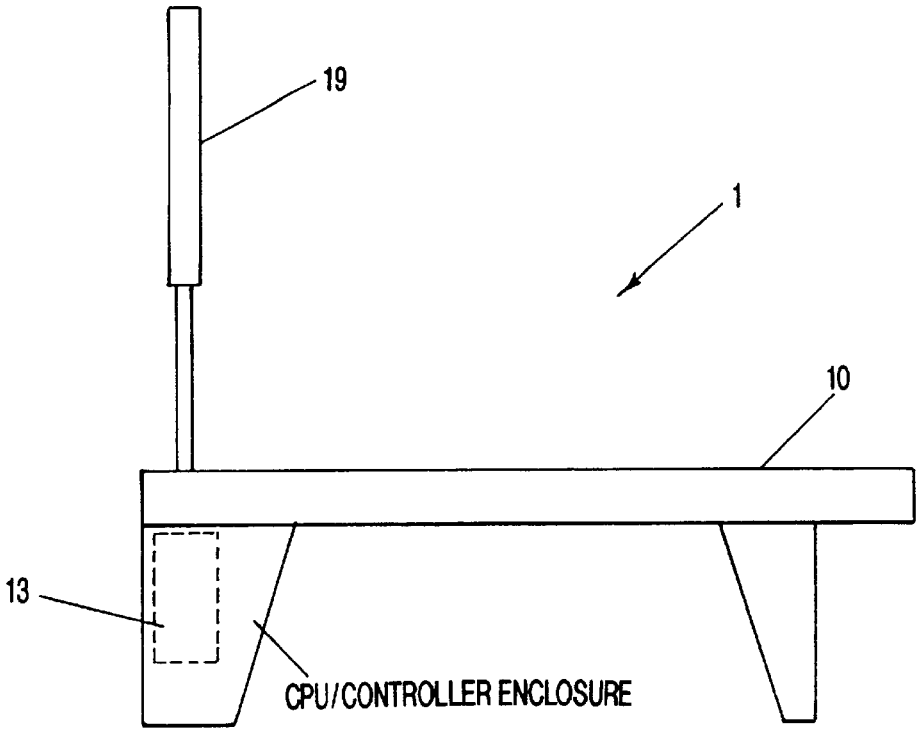
FIG. 3 is a left side view of the present invention.
Figure 4:
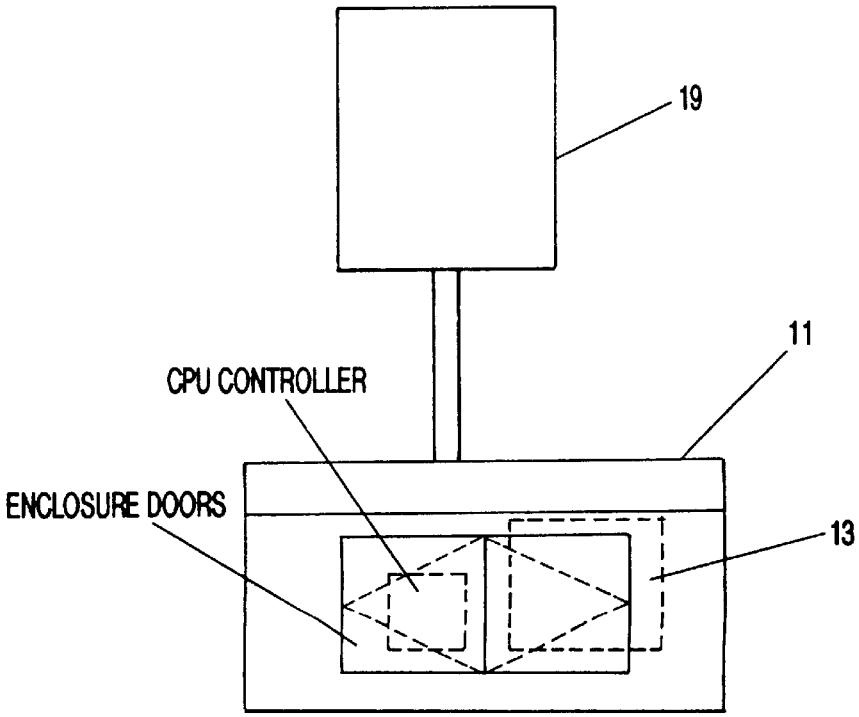
FIG. 4 is a rear view of the present invention.
Figure 9:
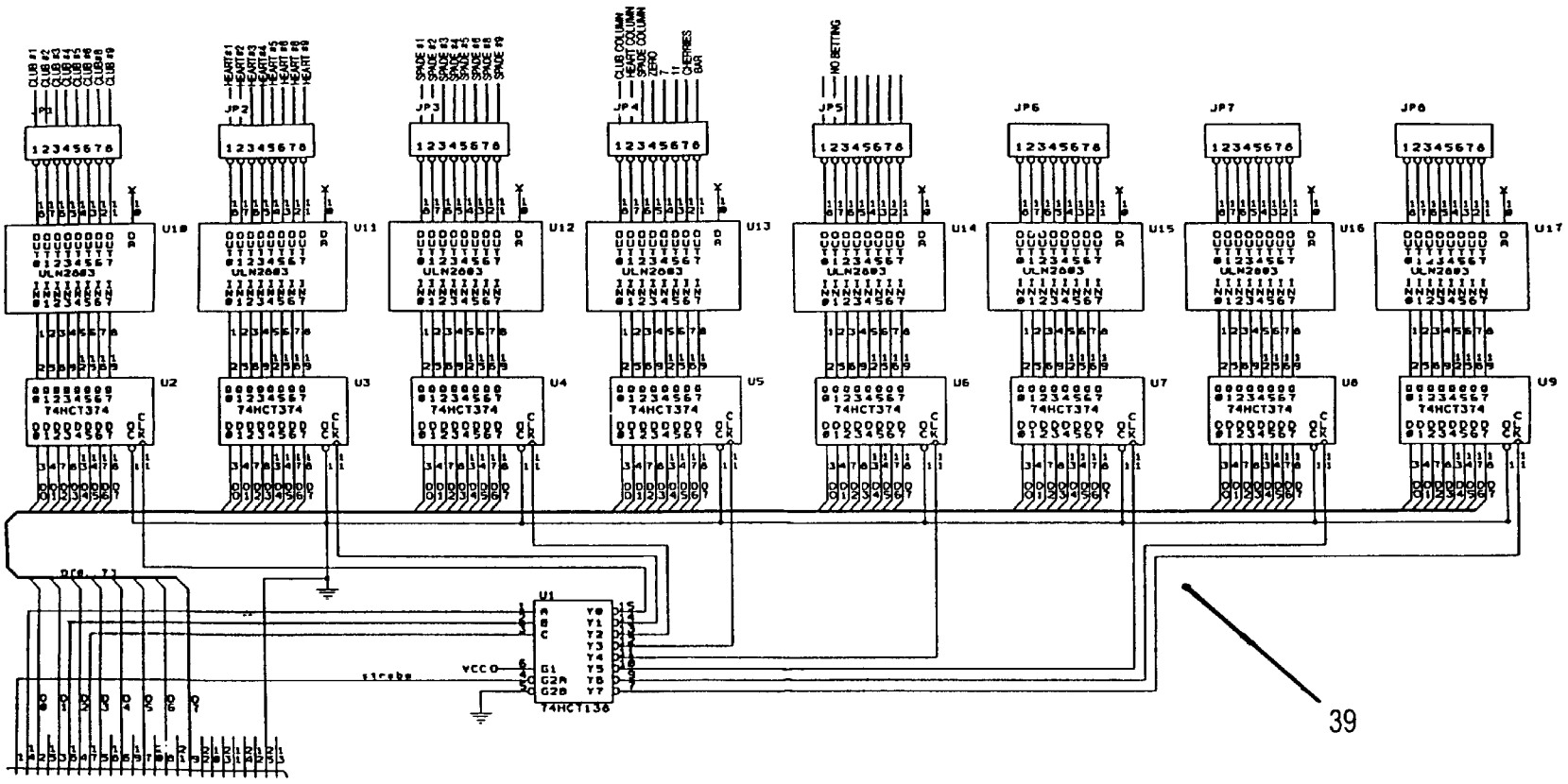
FIG. 9 is the preferred means for light control of the present invention.

The gaming device 1 shown in FIG. 1 comprises a table 10 having a top surface and a plurality of support legs, a roulette wheel 11, microcomputer 13 (as seen in FIGS. 3 and 4), a betting distribution area 15 upon a surface of table 10, a display panel unit 19, a key pad 31 and a means for light control 39 (as seen in FIG. 9). Table 10 is preferably formed of synthetic marble, granite or like material, measures 8 feet 10 inches in length and preferably is slightly sloped from head to foot.

Figure 2:
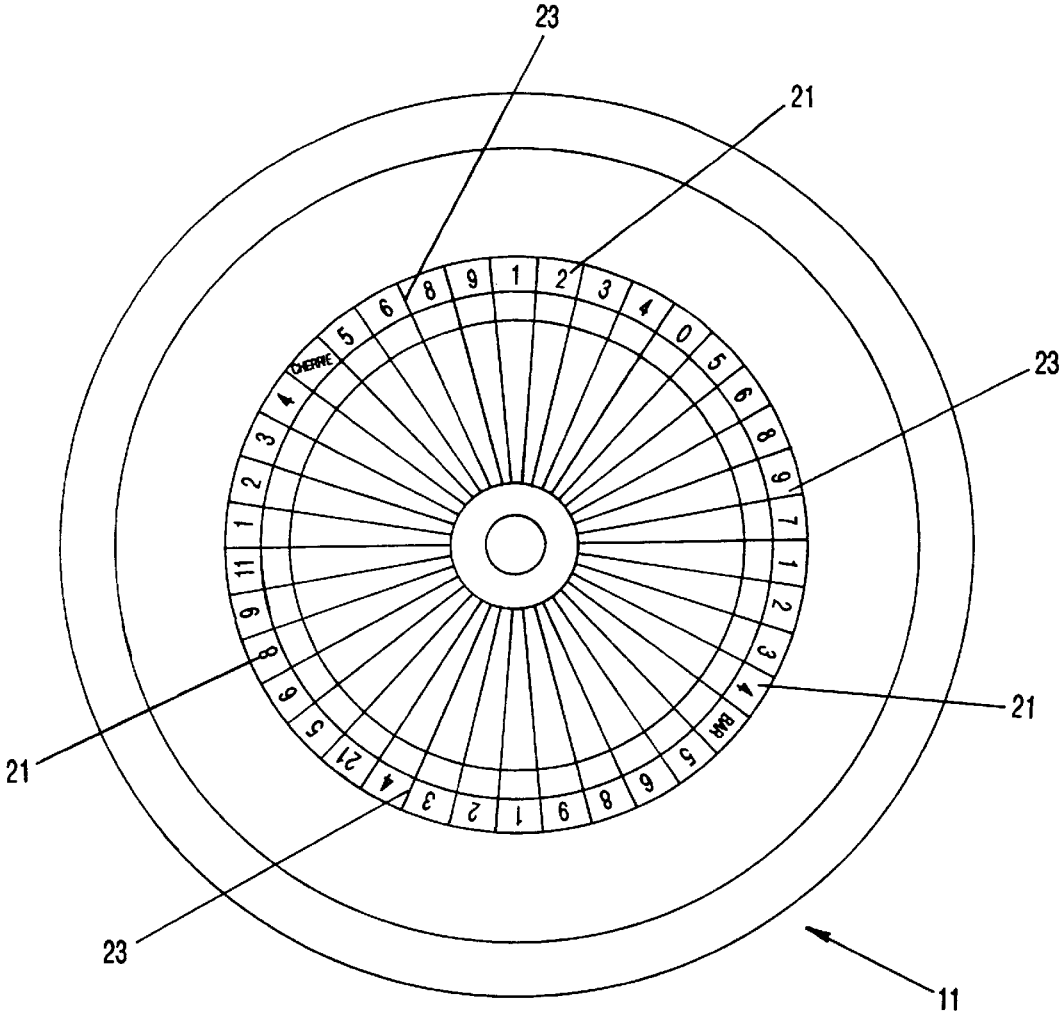
FIG. 2 illustrates the wheel of the present invention.

Wheel 11 is preferably 32 inches in diameter, and is generally formed of hand-inlaid segments of high quality wood and is perfectly balanced in its bowl. The wheel's center portion is slightly separated from the outer portion of the wheel. Therefore, in this configuration, the inner portion of the wheel rotates while the other portion of the wheel remains motionless. Unlike conventional roulette wheels, upon the present wheel's periphery are formed 38 numbered slots 21. As seen in FIG. 2, the slots are numbered with one 0, four each of the numbers 1, 2, 3, 4, 5, 6, 8 and 9, and there is one slot each for "7" "11", "BAR", "Cherries" and the number 21. Clearly, the numbered slots and the slots designated by "7", "11", "BAR" or "Cherries" is for convenience only, and those of skill in the art will realize that substitution of numbers and/or symbols is a variation within the scope of the present disclosure. Each slot is separated from adjacent slots on the wheel's periphery by small chrome rails 23, or "frets". As a ball begins to slow down in the wheel due to its reduction in momentum, the ball will hit and bounce over one or more frets before finally settling in a slot. The slots, in conjunction with the frets, are designed so as to receive only one ball at any time. Therefore, even when a plurality of balls are employed on the roulette wheel, each ball can only occupy one slot at a time. Moreover, each slot 21 within wheel 11 is adapted to employ conventional means which are adapted to detect the presence or absence of a ball (or any foreign material) in any slot.

In a preferred embodiment, wheel 11 is electronically connected to microcomputer 13 (which can also be a dedicated microcontroller circuit). As seen in FIGS. 3 and 4, microcomputer 13 is positioned below, but proximately close to wheel 11, and is adapted to control a display panel unit 19, a key pad 31 and, if desired, an optional optical number reader 37, to visibly illuminate the winning slot numbers base on information received from wheel 11. As those of skill in the art realize, microcomputer 13 can also control other aspects of this game as desired, such as ensuring the availability of balls prior to engaging a new game, determining that the wheel is spun correctly, monitoring the slots to determine whether the ball has been placed by hand (illegally) on any slot or even alerting the croupier that additional bets are placed illegally after the game has started.

As those of skill in the art will come to recognize, microcomputer 13 of the present invention can be electrically connected to other similar microcomputers (such as through a local or regional network) and is able to link all progressive jackpots together for an increased payout at any of the progressive tables so electrically linked. Further, each casino can monitor selected tables through networking of microcomputer 13 with other similar microcomputers to determine its tables payout, efficiency and whether or not one or more of their tables are experiencing problems.

Figure 10:
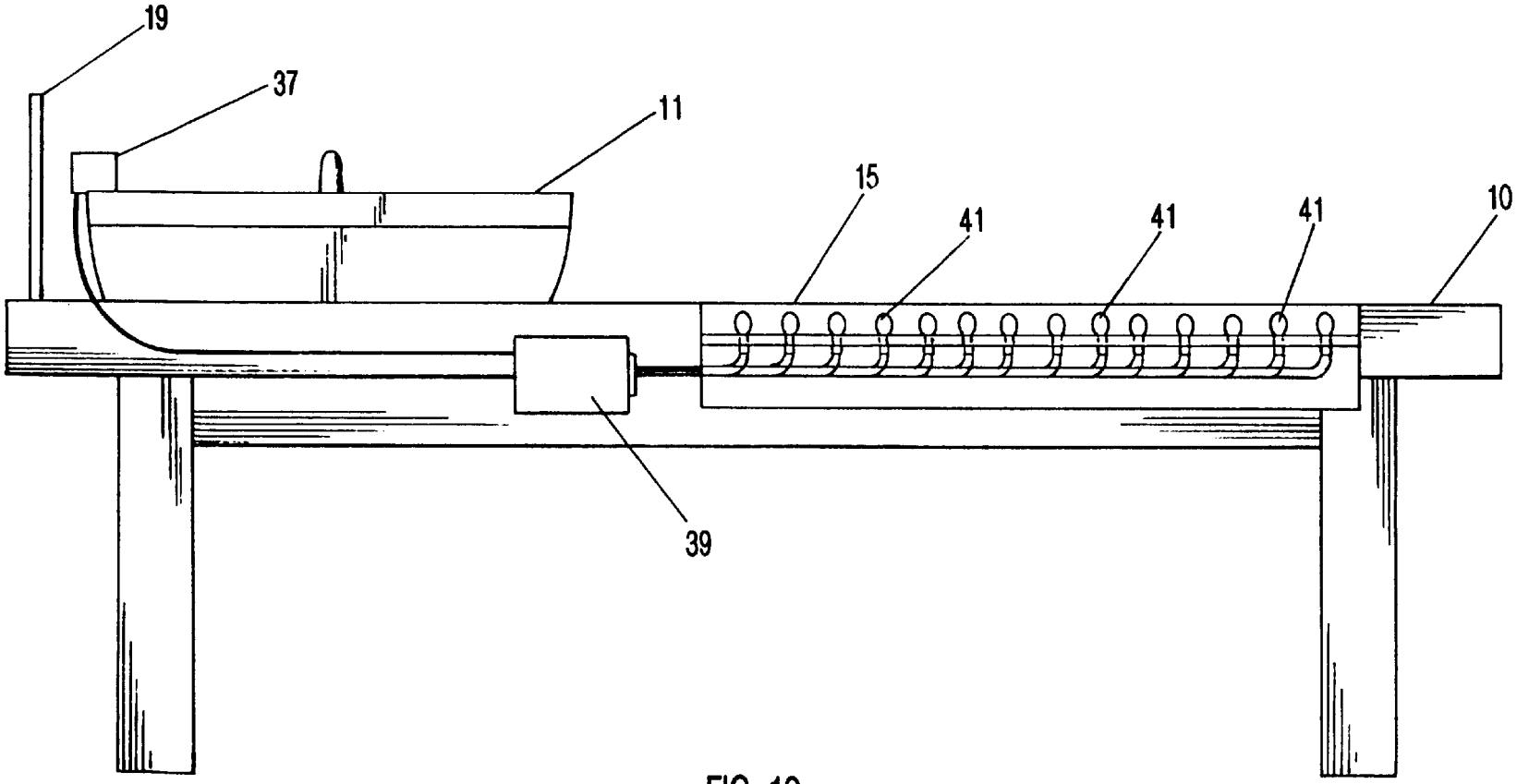
FIG. 10 is a left side partial cross sectional view of the present invention.

As seen in FIG. 9, means for light control 39 is an electronic circuit which is designed to electronically communicate with microcomputer 13, a plurality of lights 41 (as seen in FIG. 10), key pad 31 and if desired, optical number reader 37. Means for light control 39 includes a number of conventional transistor type logic (TTL) microcontrollers which communicate with microcomputer 13 to control plurality of lights 41 in a predetermined pattern. Further, as seen in FIGS. 9 and 10 (when optical number reader 37 is used), means for light control 39 includes standard parallel ports and connectors for interfacing with microcomputer 13 and plurality of lights 41. As those of skill in the art will come to realize, any conventional program code programmed into microcomputer 13 may be used to define the particular pattern of lights which are controlled.

Preferably, key pad 31 is designed to allow the croupier to manually control display panel unit 19 and betting distribution area 15. As such, the only buttons required in this embodiment is a button marked "C" for clearing/turning off all display lights and sending a progressive value to microcomputer 13; a button marked "N" for turning on the "NO MORE BETTING" display unit 29*a* and emblem 29; a button marked "J" (for Jackpot); and buttons marked "0", "1", "2", "3", "4", "5", "6", "7/11", "8" and "9". Thus, at the end of each game, the croupier determines how many players have played the progressive jackpot, and enters this information into microcomputer 13 by first pressing the "J" button and then the button corresponding to the number of players playing the progressive jackpot. Thus, if only one player plays the progressive jackpot, the croupier would first press the "J" button and then the button labeled "1". Finally, the croupier presses the "C" button to restart the game. Clear button 33, when engaged by the croupier, turns off all lights on the display panel unit 19 and sets the progressive amount to the proper meter display according to the amount won and lost by each player. Further, depressing clear button 33 also serves to send a value to the reserve accumulator of microcomputer 13 and a value which represents the house management's (or, casino) predetermined portion of the proceeds (or, "take") of the game.

Figure 7:
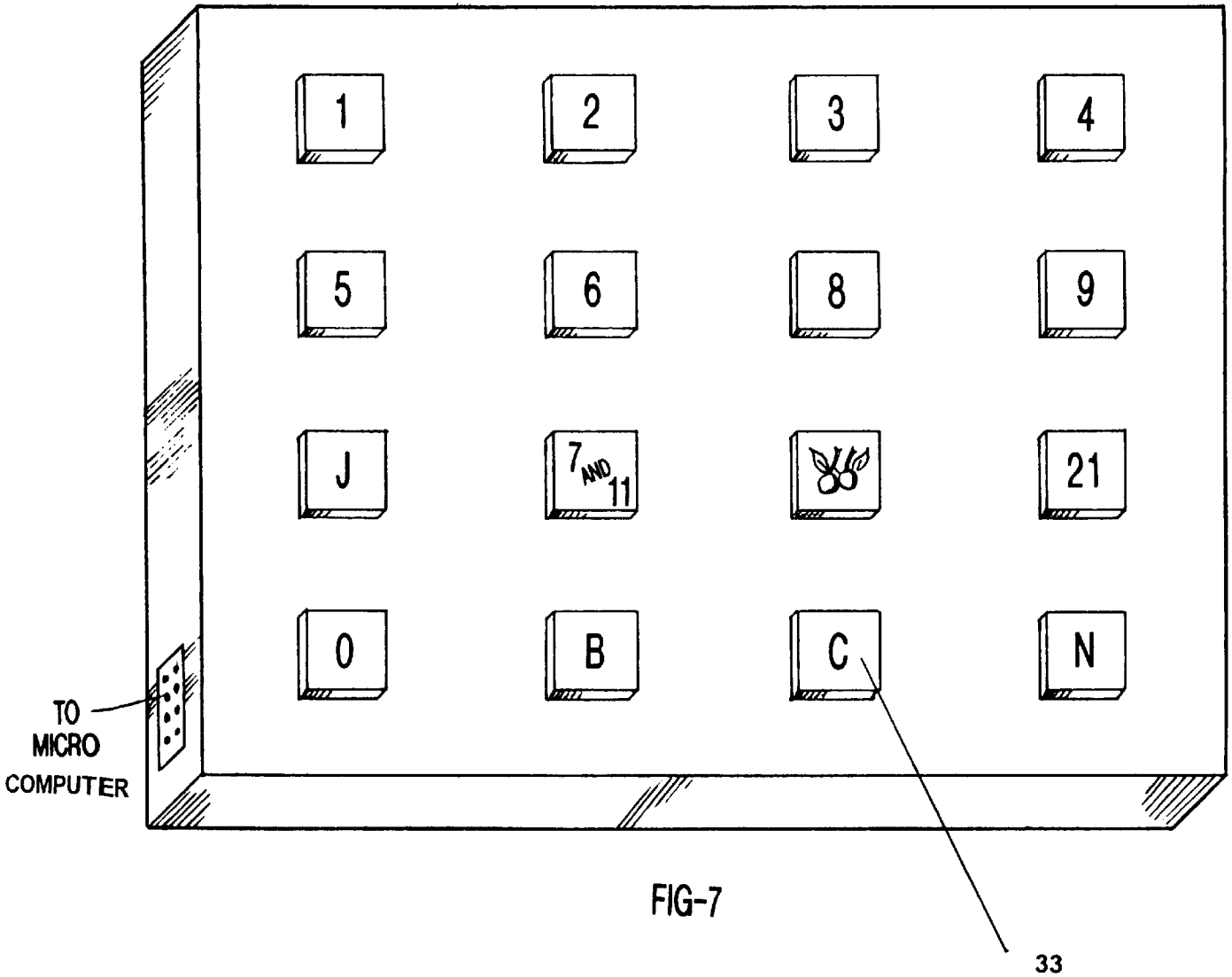
FIG. 7 illustrates the key pad of the present invention.

In some instances, the use of an optical number reader 37 may be too expensive for some casinos. As such, as seen in FIG. 7, a modified key pad 31 is designed to allow the croupier to manually control other lights on display panel unit 19 and betting distribution area 15. In this embodiment, modified key pad 31 further includes a plurality of buttons, marked "21", "Ch" (for Cherries) and "B" (for Bar), each button corresponding to a labeled slot 21 on wheel 11. Modified key pad 31, when used, is placed on table 10 and is in electronic communication with microcomputer 13. Modified key pad 31 is provided for the benefit of the croupier, as it is designed to allow the croupier to control the play of each successive game.

A conventional optical number reader 37 (as seen in FIG. 1) can also be employed to receive information from the roulette wheel relating to the which particular slot at which the ball comes to rest. Once this information is available to optical number reader 37, the information is sent to microcomputer 13 electronically for processing. The advantage of employing optical number reader 37 is that it takes several functions away from the croupier, thereby allowing him to focus on other aspects of the game.

Figure 5:
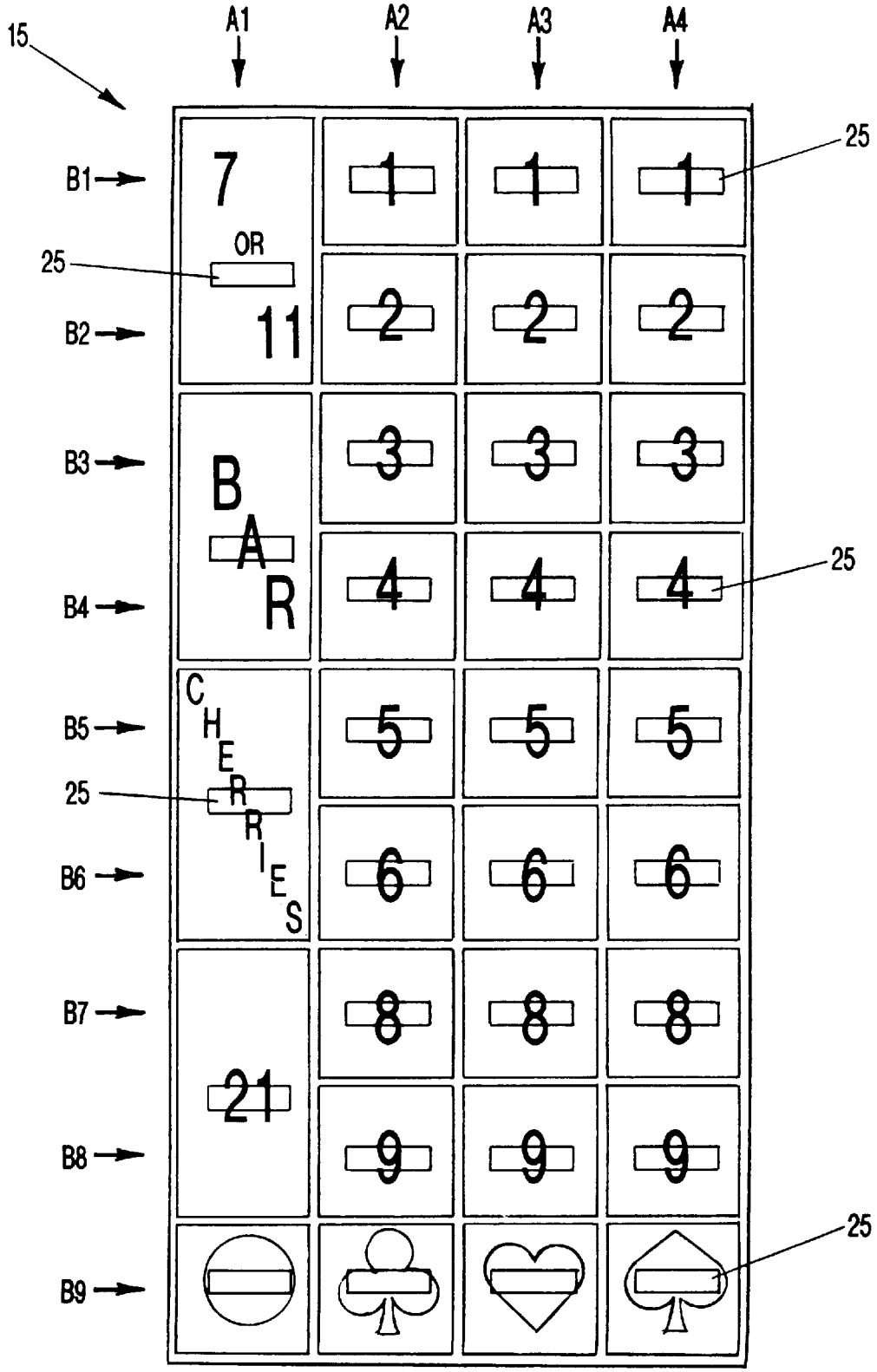
FIG. 5 illustrates the betting distribution area of the present invention.

A betting distribution area 15 is graphically formed upon the top of table 10 in close proximity to wheel 11. In the preferred embodiment, the betting distribution area is approximately 17¼ inches by 38½ inches and includes a tempered glass pane. As seen in FIG. 5, and unlike conventional roulette, betting distribution area 15 includes four vertical columns A1–A4 and nine horizontal rows B1–B9, forming an overall rectangular pattern. The first vertical column includes five cells, with four of the five cells (A1B1 through A1B8) being equivalent in height as two horizontal rows. The last cell of the first vertical column, A1B9, is equivalent in height as a single horizontal row. The remainder of the cells are all of equivalent size, generally in a square pattern.

As seen in FIG. 5, betting distribution area 15 is uniquely identified and labeled. In the preferred embodiment, cell A1B1B2 is identified by "7 or 11"; cell A1B3B4 is identified by "BAR"; cell A1B5B6 is identified by "Cherries"; cell A1B7B8 is identified by "21"; and cell A1B9 is identified by "0". The cells in the second vertical column A2B1 through A2B6 each contain a sequential consecutive number 1 through 6. Cells A2B7 though A2B8 each contain the sequential consecutive numbers 8 and 9. Cell A2B9 is identified by the "club" symbol. For the remaining two vertical columns A3 and A4, the same sequence is repeated as the second vertical column with the exception of cells A3B9 and A4B9. In this regard, A3B9 is identified by a "heart" symbol, whereas cell A4B9 is identified by a "spade" symbol. Each cell identified in FIG. 5 also contains a rectangular box (shown generally as item 25) superimposed behind each number or symbol. Each rectangular box 25 provides information to the players of the winning odds (or payout) for each cell selected, which is predetermined by the casino.

Figure 6:
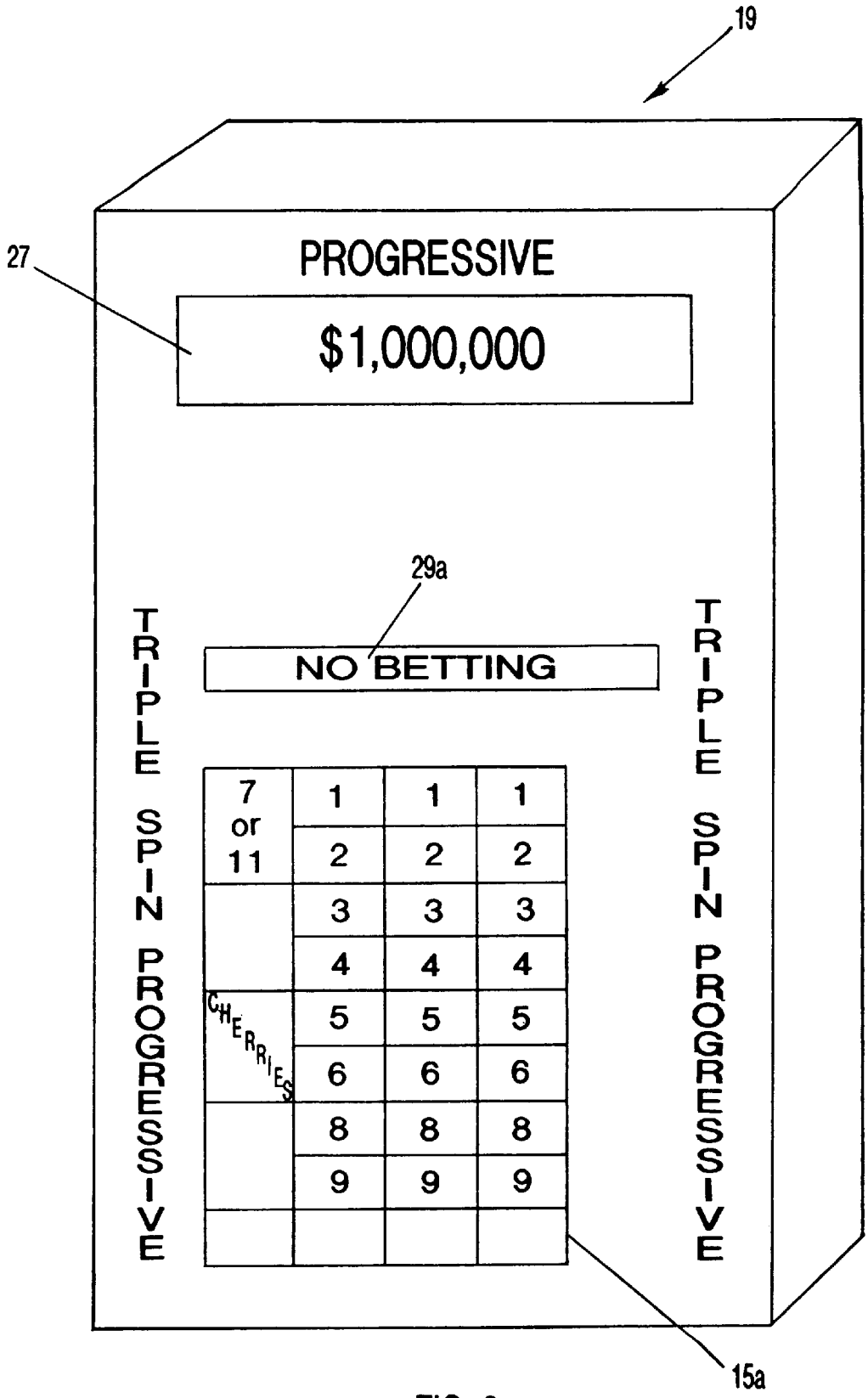
FIG. 6 illustrates the display panel unit of the present invention.

Returning to FIG. 1, display panel unit 19 is preferably a rectangular box structure connected to table 10 in an upright position by support structure 26, and is prominently located adjacent to wheel 11 at the top of table 10 for direct viewing by any player and/or operator. As seen in FIG. 6, display panel unit 19 includes a graphical mirror image of the symbols identified by the betting distribution area 15*a* upon table top 10. Additionally, display panel unit 19 further includes a progressive payout display unit 27 and a no betting display unit 29. Preferably, display panel unit 19 is formed of marble, granite, wood or any similar aesthetically pleasing material accepted by gaming regulatory authorities. Within the confines of display panel unit 19 (and behind no betting display unit 29 and betting distribution area 15*a*) are attached a plurality of lights (not shown, but similar to the plurality of lights identified in FIG. 10 as item 41). Such lights are placed strategically within display panel unit's box structure and are controlled by and in electrical communication with microcomputer 13.

Betting distribution display unit 15*a* is preferably located in a central viewing area of display panel unit 19, and includes a plurality of lights. A light is placed behind each representative cell from the betting distribution area 15. As a ball falls into a particular slot 21 on wheel 11, the optical number reader 37 (or the croupier, if no optical number reader 37 is employed) will sense this occurrence, send a signal to microcomputer 13 which then controls a particular light on betting distribution display unit 15*a* to enable the players and/or the croupier and to determine which balls fell into what slots on the wheel.

For ease of viewing, progressive payout display unit 27 is preferably positioned near the top of display panel unit 19. Progressive payout display unit 27 is controlled by and in electrical communication with microcomputer 13. Progressive payout display unit 27 displays the amount of progressive jackpot available. In particular, microcomputer 13 is also adapted to function as a progressive controller which is programmed by any conventional programming language to maintain accurate count of two amounts: an accumulated jackpot amount and a reserve amount. Microcomputer 13 is adapted to calculate the progressive jackpot value at the table, the amount of money being played as well as determining whether a jackpot has been hit. This information is easily transferable to any other connected microcomputer for the proper display and incrementation of the progressive jackpot value. Microcomputer 13 also monitors jackpot wins to acknowledge such wins and to thereby reset the jackpot value to a predetermined base amount for continued play. The proportion of money maintained by the jackpot (or, progressive) is a set amount multiplied by the amount of players playing the jackpot. For example, if there are two players playing the jackpot, each betting the minimum bet of $1.00, and the casino pre-sets the rate at 62 cents per play to be applied towards the progressive jackpot amount, the amount sent by microcomputer 13 to progressive payout display unit 27 is increased by $1.24 cents. In this example, therefore, 10 cents will be accumulated into the reserve amount (which, accordingly, can be modified by the casino), with the remaining 66 cents going to the casino (or, "household"). The reserve amount is used solely to replenish the jackpot once a player has won the jackpot. Finally, as those of skill in the art realize, each microcontroller 13 is not limited to working with only a single table, but rather, can be linked into other progressive gaming devices locally, regionally or globally.

The no betting display unit 29*a* is controlled by and in electrical communication with microcomputer 13, and serves to operate simultaneously with no betting emblem 29 in the top of table 10. As such, when no betting emblem 29 turns on, so does no betting display unit 29*a* . Similarly, when no betting emblem 29 turns off, so does no betting display unit 29*a*.

Figure 8:
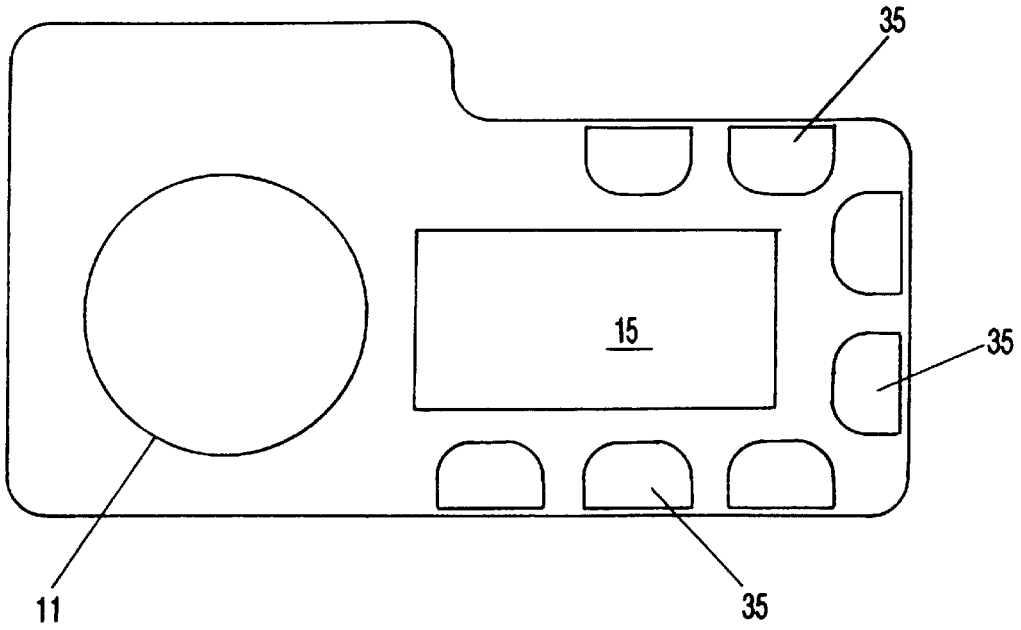
FIG. 8 is a top side view of the present invention, illustrating a plurality of player areas.

Finally, as seen in FIG. 8, optional player areas 35 can also be inlaid into table 10 for convenience of the players.

In operation, the present game preferably allows up to seven players to play. Initially, each player places a bet in desired labeled locations within betting distribution area 15. When ready, the croupier will notify the players that no further bets will be accepted by pressing the button labeled "N" on key pad 31 to signify the start of the game. When the "N" button is depressed, the no betting light 29*a* on the display panel unit and the no betting emblem 29 both simultaneously turn on to notify players that no further bets will be accepted. Then, wheel 11 is spun by the croupier and up to three ivory (or equivalent) balls are spun by the croupier or by any conventional means in a direction opposite the wheel's direction. When all three balls fall into slots on the wheel (never with two balls occupying the same slot), either the croupier can depress those numbers on key pad 31 corresponding to where the balls fell into the winning slots, or, the optical number reader 37 (if used) will communicate this information to microcomputer 13 for display on display panel unit 19. The croupier then determines any payout based on the wagered bets and odds of winning, and appropriately pays each player who wins. Finally, the croupier depresses the clear button 33 to signify the start of a new game.

In order to play the game, unconventional rules are designed to enhance player excitement and attraction while providing an opportunity to enhance casino profit. In particular, the apparatus of the present invention is designed for play based on special rules.

The progressive jackpot is won only when a player wagers bets across three identical numbers in the betting distribution area (e.g., bets are placed on all numbers in a horizontal row except for the first column). Then, when the croupier injects up to three balls into wheel 11, each ball successively falls into at least three slots. For a progressive jackpot win, all three balls must land in the three identical numbers selected by the player. For example, if a player bets all the "1"s in the betting distribution area (e.g., A2B1, A3B1 and A4B1 as seen in FIG. 5), and later, the three balls fall into three of the four "1"s labeled on the wheel, the player would win and be paid the payoff odds set by the casino (preferably, 1000 to 1) plus the progressive jackpot.

When a player selects any of the numbered cells A2B1 through A2B8 (i.e., 1, 2, 3, 4, 5, 6, 8 or 9, as identified as in FIG. 5), the player is betting that at least one of the three balls will fall into one of the four identical slots on the wheel. If this occurs, the lights in this column will turn on appropriately, the player will win the game and will be paid 2 to 1. The odds are low because the player has a better chance of winning, since there is a high probability that one of the three balls will fall into any of the numbered (i.e., 1, 2, 3, 4, 5, 6, 8 or 9) slots on the wheel.

When a player selects any of the numbered cells A3B1 through A3B8 (i.e., 1, 2, 3, 4, 5, 6, 8 or 9, as identified as in FIG. 5), the player is betting that at least two of the three balls will fall into two of the four identical slots on the wheel. If this occurs, the lights in this column will turn on appropriately, the player will win the game and will be paid 35 to 1. The odds are increased because the player has a lower probability that two of the three balls will fall into any of the numbered (i.e., 1, 2, 3, 4, 5, 6, 8 or 9) slots on the wheel.

When a player selects any of the numbered cells A4B1 through A4B8 (i.e., 1, 2, 3, 4, 5, 6, 8 or 9, as identified as in FIG. 5), the player is betting that at all three of the three balls will fall into three of the four identical slots on the wheel. If this occurs, the lights in this column will turn on appropriately, the player will win the game and will be paid 1000 to 1. The odds are greatly increased because the player has a significantly lower probability that the three balls will fall into any of the numbered (i.e., 1, 2, 3, 4, 5, 6, 8 or 9) slots on the wheel.

When a player selects the "7 or 11" cell, the player is really selecting the cell identified by A1B1B2. In this case, if any of the three balls fall into either the 7 slot or the 11 slot, the light in this cell will turn on appropriately and the player would win with a payoff odds of 5 to 1. However, if one of the three balls falls into the 7 slot, and another ball falls into the 11 slot, the player receives a payoff of 220 to 1.

When a player selects the "BAR", the player is really selecting the cell identified by A1B3B4. In this case, if any of the three balls fall into the single BAR slot in the wheel, the light in this cell will turn on appropriately and the player would win with a payoff odds of 11 to 1.

When a player selects the "Cherries", the player is really selecting the cell identified by A1B5B6. In this case, if any of the balls fall into the single Cherries slot in the wheel, the light in this cell will turn on appropriately and the player would win with a payoff odds of 11 to 1.

When a player selects the "21 " (or, "lucky 21"), the player is really selecting the cell identified by A1B7B8. In this case, if any of the balls fall into the single 21 slot in the wheel, the light in this cell will turn on appropriately and the player would win with a payoff odds of 11 to 1.

When a player selects the "0", the player is really selecting the cell identified by A1B9. In this case, if any of the three balls fall into the single 0 slot in the wheel, the light in this cell will turn on appropriately and the player would win with a payoff odds of 11 to 1.

When a player selects the "Club", the player is really selecting the vertical column A2B1 through A2B8. In this case, the vertical row includes the numbers 1, 2, 3, 4, 5, 6, 8 and 9. In order to win when the "Club" is selected, three out of the eight numbers in the column must light up according to the rules described above. In this situation, payoff odds are 1 to 1.

When a player selects the "Heart", the player is really selecting the vertical column A3B1 through A3B8. In this case, the vertical row includes the numbers 1, 2, 3, 4, 5, 6, 8 and 9. In order to win when the "Heart" is selected, any one out of the eight numbers in the column must light up according to the rules described above. In this situation, payoff odds are 35 to 1.

When a player selects the "Spade", the player is really selecting the vertical column A4B1 through A4B8. In this case, the vertical row includes the numbers 1, 2, 3, 4, 5, 6, 8 and 9. In order to win when the "Spade" is selected, any one out of the eight numbers in the column must light up according to the rules described above. In this situation, payoff odds are 250 to 1.

Whereas the drawings and accompanying description have shown and described the preferred embodiment of the present invention, it should be apparent to those skilled in the art that various changes may be made in the form of the invention without affecting the scope thereof.

What I claim is:

1. A gaming apparatus comprising:

a. a table having a top and a plurality of support legs;

b. a modified roulette wheel integrally mounted on the table top, the wheel having a plurality of slots on its periphery, each slot labeled in a preselected pattern with a predetermined pattern of numbers and symbols;

d. a microcomputer proximately located near the roulette wheel;

c. a betting distribution area integrally formed on the table top adjacent to the roulette wheel, the betting distribution area having a first plurality of labeled spaces, the betting distribution area further including a first plurality of lights in electrical communication with the microcomputer;

e. a means for displaying game information attached to one end of the table in an upright position; and f. a means for light control, the means for light control being in electrical communication with the microcomputer and the first plurality of lights.

2. The gaming apparatus of claim 1, wherein each slot in the predetermined pattern of numbers and symbols is marked with one "0"; four each of the numbers 1, 2, 3, 4, 5, 6, 8 and 9; "7 or 11 "; "BAR"; "Cherries"; and "21", and wherein each of the first plurality of labeled spaces is marked with one "0"; four each of the numbers 1, 2, 3, 4, 5, 6, 8 and 9; "7 or 11"; "BAR"; "Cherries"; "21", a circle, a club, a heart and a spade.

3. The gaming apparatus of claim 2, wherein the microcomputer is in electrical communication with the roulette wheel.

4. The gaming apparatus of claim 3, wherein the microcomputer is in electrical communication with a plurality of remotely located microcomputers.

5. The gaming apparatus of claim 2, wherein the betting distribution area comprises four vertical columns and nine horizontal rows.

6. The gaming apparatus of claim 2, wherein the means for displaying game information further comprises a betting distribution display unit and a progressive payout display unit.

7. The gaming apparatus of claim 6, wherein the betting distribution display unit is a mirror image of the betting distribution area, the betting distribution display unit further including a second plurality of labeled spaces and a second plurality of lights corresponding exactly to the first plurality of labeled spaces and first plurality of lights, the second plurality of lights being in electrical communication with the means for light control.

8. The gaming apparatus of claim 6, further including a no betting emblem integrally formed into the gaming table, and wherein the means for displaying game information further comprises a no betting display unit, the microcomputer adapted to control the no betting emblem and the no betting display unit concurrently.

9. The gaming apparatus of claim 6, further including a key pad, the key pad being in electrical communication with the microcomputer.

10. The gaming apparatus of claim 6, further including an optical number reader attached to the modified roulette wheel, the optical number reader being in electrical communication with the means for light control.

11. A method for one or more players to progressively wager on a game based upon a revised roulette wheel, the steps of playing the progressive game comprising:

a. each player placing a wager on a table top betting distribution area to participate in the game;

b. spinning a revised roulette wheel located on the table top, the wheel having a plurality of slots on its periphery, each slot labeled in a preselected pattern with a predetermined pattern of numbers and symbols;

c. injecting three balls into the wheel in a direction opposite the rotation of the wheel;

d. allowing each of the three balls to fall into three slots;

e. determining the slot locations of each fallen ball;

f. controlling a plurality of display units by a means for light control and a microcomputer to display the slot locations; and g. allowing one or more players to win based upon their wager and predefined rules.

12. The method of claim 11, wherein each slot in the predetermined pattern of numbers and symbols comprise one "0"; four each of the numbers 1, 2, 3, 4, 5, 6, 8, and 9; and "7 and 11", "BAR", "Cherries"; and "21", and wherein the betting distribution area comprises four vertical columns and nine horizontal rows.

13. The method of claim 12, wherein the predefined rules, per game, comprises:

(a) winning a progressive jackpot when a player wagers bets across cells having three identical numbers in the betting distribution area and each of the three balls successively lands in the wheel's slots having the three corresponding numbers selected by the player;

(b) winning a low payoff being won when the player wagers bets in any numbered cells in the second column of the betting distribution area marked 1, 2, 3, 4, 5, 6, 8 or 9, and at least one of the three balls falls into one of the correspondingly numbered slot on the wheel;

(c) winning an increased payoff when the player selects any of the numbered cells in the third column of the betting distribution area marked 1, 2, 3, 4, 5, 6, 8 or 9, and at least two of the three balls fall into two of correspondingly numbered slots on the wheel;

(d) winning a significantly increased payoff when a the player selects any of the numbered cells in the fourth column of the betting distribution area marked 1, 2, 3, 4, 5, 6, 8 or 9, and all three balls fall into three correspondingly numbered slots on the wheel;

(e) winning a payoff when the player selects the "7 or 11" cell in the first column of the betting distribution area, and any of the three balls fall into either the 7 slot or the 11 slot on the wheel;

(f) winning a increased payoff when the player selects the "7 or 11" cell in the first column of the betting distribution area, and two of the the three balls fall into both the 7 slot and the 11 slot on the wheel;

(g) winning a payoff when the player selects the "BAR" cell in the first column of the betting distribution area, and any of the three balls fall into the corresponding slot identified by "BAR" on the wheel;

(h) winning a payoff when the player selects the "Cherries" cell in the first column of the betting distribution area, and any of the three balls fall into the corresponding slot identified by "Cherries" on the wheel;

(i) winning a payoff when the player selects the "21" cell in the first column of the betting distribution area, and any of the three balls fall into the corresponding slot identified by "21" on the wheel;

(j) winning a payoff when the player selects the "0" cell in the first column of the betting distribution area, and any of the three balls fall into the corresponding slot identified by the "0" on the wheel;

(k) winning a payoff when the player selects the "Club" cell in the second column of the betting distribution area, such selection constituting a club column bet, and all three balls fall into three separate correspondingly numbered slots on the wheel;

(l) winning an increased payoff when the player selects the "Heart" cell in the third column of the betting distribution area, such selection constituting a heart column bet, and at least two of the three balls fall into two correspondingly numbered slots on the wheel; and (m) winning a significantly increased payoff when the player selects the "Spade" cell in the fourth column of the betting distribution area, such selection constituting a spade column bet, and all three balls fall into three correspondingly numbered slots on the wheel.

14. The method of claim 11, wherein the step of determining the slot location of the fallen ball is executed by an optical number reader.

15. The method of claim 13, wherein the progressive game is progressive because at least some amount of any lost wager remains in an accumulator in the microcomputer for a preselected amount of time.

16. The method of claim 11 wherein the preselected amount of time is determined by accumulating a predetermined number of eligible players.

17. A gaming apparatus comprising:

a. a table having a top and a plurality of support legs;

b. a wheel integrally mounted on the table top, the wheel having a plurality of slots on its periphery, each slot labeled with one "0"; four each of the numbers 1, 2, 3, 4, 5, 6, 8 and 9; "7 and 11"; "BAR"; "Cherries"; and "21";

d. a microcomputer proximately located adjacent to the roulette wheel;

c. a betting distribution area inlaid on the table top adjacent to the roulette wheel, the betting distribution area having a plurality of labeled spaces substantially corresponding to the labels in the wheel's plurality of slots, the betting distribution area being in electrical communication with the microcomputer through an electrical circuit; and e. a display panel unit attached to one end of the table, the display panel unit being in electrical communication with the microcomputer through the electrical circuit and adapted to display the plurality of labeled spaces.

18. The gaming apparatus of claim 16, wherein the microcomputer is in electrical communication with the roulette wheel.

19. The gaming apparatus of claim 17, further including a key pad which is in electrical communication with the microcomputer through the electrical circuit.

20. The gaming apparatus of claim 18, wherein the betting distribution display unit is a mirror image of the betting distribution area, the betting distribution display unit further including a plurality of lights corresponding to the plurality of labeled spaces, the plurality of lights being in electrical communication with the microcomputer through the electrical circuit.

* * * * *